US009484645B2

(12) United States Patent
Matzen

(10) Patent No.: US 9,484,645 B2
(45) **Date of Patent: *Nov. 1, 2016**

(54) QUICK MOUNT CONNECTOR FOR A COAXIAL CABLE

(71) Applicant: CORNING OPTICAL COMMUNICATIONS RF LLC, Glendale, AZ (US)

(72) Inventor: Michael Ole Matzen, Vordingborg (DK)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/833,845

(22) Filed: Aug. 24, 2015

(65) Prior Publication Data

US 2015/0364842 A1 Dec. 17, 2015

Related U.S. Application Data

(63) Continuation of application No. 13/732,679, filed on Jan. 2, 2013, now Pat. No. 9,136,654.

(60) Provisional application No. 61/583,385, filed on Jan. 5, 2012.

(51) Int. Cl.
*H01R 24/38* (2011.01)
*H01R 9/05* (2006.01)

(52) U.S. Cl.
CPC ..... *H01R 9/05* (2013.01); *H01R 9/0524* (2013.01); *H01R 24/38* (2013.01); *H01R 9/0521* (2013.01)

(58) Field of Classification Search
CPC ... H01R 24/38; H01R 9/0524; H01R 9/0521
USPC ..... 439/584, 578
See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |

(Continued)

FOREIGN PATENT DOCUMENTS

| | | |
|---|---|---|
| CA | 2096710 | 11/1994 |
| CN | 1210379 | 3/1999 |

(Continued)

OTHER PUBLICATIONS

Corning Gilbert 2004 OEM Coaxial Products Catalog, Quick Disconnects, 2 pages.

(Continued)

*Primary Examiner* — Briggitte R Hammond

(57) ABSTRACT

A post-less coaxial cable connector includes a body, a shell, a compression ring, and a coupling portion. The shell has a collapsible groove that, when the post-less coaxial cable connector is axially compressed, collapses and engages the coaxial cable. This provides pull strength and electrical communication in the post-less coaxial cable connector. The compression ring has projections, that when the post-less coaxial cable connector is axially compressed, engage the coaxial cable jacket, providing sealing at the back end and rotation torque.

14 Claims, 4 Drawing Sheets

(56) References Cited

U.S. PATENT DOCUMENTS 1,371,742 A 3/1921 Dringman
1,488,175 A 3/1924 Strandell
1,667,485 A 4/1928 MacDonald
1,766,869 A 6/1930 Austin
1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,743,505 A 5/1956 Hill
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,161,451 A 12/1964 Neidecker
3,184,706 A 5/1965 Atkins
3,193,309 A 7/1965 Morris
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A * 10/1970 Winston ..... H01B 17/306 439/584
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaloene
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,824,026 A 7/1974 Gaskins
3,835,443 A 9/1974 Arnold et al.
3,836,700 A 9/1974 Niemeyer
3,845,453 A 10/1974 Hemmer
3,846,738 A 11/1974 Nepovim
3,847,463 A 11/1974 Hayward et al.
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,012,105 A 3/1977 Biddle
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.

(56) References Cited

U.S. PATENT DOCUMENTS 4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Boutros
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Heide et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,274 A 7/1988 Bowers
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.

(56) References Cited

U.S. PATENT DOCUMENTS 4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,475,921 A 12/1995 Johnston
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,511,305 A 4/1996 Garner
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.

(56) References Cited

U.S. PATENT DOCUMENTS 5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A * 5/1997 Szegda ..... H01R 9/05 439/578
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,759,618 A 6/1998 Taylor
5,769,652 A 6/1998 Wider
5,769,662 A 6/1998 Stabile et al.
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,874,603 A 2/1999 Arkles
5,877,452 A 3/1999 McConnell
5,879,191 A 3/1999 Burris
5,882,226 A 3/1999 Bell et al.
5,890,924 A 4/1999 Endo
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Bartholomew
6,080,015 A 6/2000 Andreescu
6,083,030 A 7/2000 Wright
6,083,053 A 7/2000 Anderson, Jr. et al.
6,089,903 A 7/2000 Stafford Gray et al.
6,089,912 A * 7/2000 Tallis ..... H01R 9/05 439/583
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,126,487 A 10/2000 Rosenberger et al.
6,132,234 A 10/2000 Waidner et al.
6,142,812 A 11/2000 Hwang
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,942 B1 6/2001 Lemke et al.
6,250,974 B1 6/2001 Kerek
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,379,183 B1 4/2002 Ayres et al.
6,394,840 B1 5/2002 Gassauer et al.
6,396,367 B1 5/2002 Rosenberger
D458,904 S 6/2002 Montena
6,398,571 B1 6/2002 Nishide et al.
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,443,763 B1 9/2002 Richet
6,450,829 B1 9/2002 Weisz-Margulescu
6,454,463 B1 9/2002 Halbach
6,464,526 B1 10/2002 Seufert et al.
6,464,527 B2 10/2002 Volpe et al.
6,467,816 B1 10/2002 Huang
6,468,100 B1 10/2002 Meyer et al.
6,491,546 B1 12/2002 Perry
D468,696 S 1/2003 Montena
6,506,083 B1 1/2003 Bickford et al.
6,510,610 B2 1/2003 Losinger
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh

(56) References Cited

U.S. PATENT DOCUMENTS 6,637,101 B2 10/2003 Hathaway et al.
6,645,011 B2 11/2003 Schneider et al.
6,663,397 B1 12/2003 Lin et al.
6,676,446 B2 1/2004 Montena
6,683,253 B1 1/2004 Lee
6,683,773 B2 1/2004 Montena
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,709,289 B2 3/2004 Huber et al.
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,743,040 B1 6/2004 Nakamura
6,749,454 B2 6/2004 Schmidt et al.
6,751,081 B1 6/2004 Kooiman
6,752,633 B2 6/2004 Aizawa et al.
6,761,571 B2 7/2004 Hida
6,767,248 B1 7/2004 Hung
6,769,926 B1 8/2004 Montena
6,780,029 B1 8/2004 Gretz
6,780,042 B1 8/2004 Badescu et al.
6,780,052 B2 8/2004 Montena et al.
6,780,068 B2 8/2004 Bartholoma et al.
6,783,394 B1 8/2004 Holliday
6,786,767 B1 9/2004 Fuks et al.
6,790,081 B2 9/2004 Burris et al.
6,793,528 B2 9/2004 Lin et al.
6,796,847 B2 9/2004 AbuGhazaleh
6,802,738 B1 10/2004 Henningsen
6,805,581 B2 10/2004 Love
6,805,583 B2 10/2004 Holliday et al.
6,805,584 B1 10/2004 Chen
6,808,415 B1 10/2004 Montena
6,817,272 B2 11/2004 Holland
6,817,896 B2 11/2004 Derenthal
6,817,897 B2 11/2004 Chee
6,827,608 B2 12/2004 Hall et al.
6,830,479 B2 12/2004 Holliday
6,848,115 B2 1/2005 Sugiura et al.
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,887,102 B1 5/2005 Burris et al.
6,916,200 B2 7/2005 Burris et al.
6,929,265 B2 8/2005 Holland et al.
6,929,508 B1 8/2005 Holland
6,935,866 B2 8/2005 Kerekes et al.
6,939,169 B2 9/2005 Islam et al.
6,942,516 B2 9/2005 Shimoyama et al.
6,942,520 B2 9/2005 Barlian et al.
6,945,805 B1 9/2005 Bollinger
6,948,976 B2 9/2005 Goodwin et al.
6,953,371 B2 10/2005 Baker et al.
6,955,563 B1 10/2005 Croan
D511,497 S 11/2005 Murphy et al.
D512,024 S 11/2005 Murphy et al.
D512,689 S 12/2005 Murphy et al.
6,971,912 B2 12/2005 Montena et al.
7,008,263 B2 3/2006 Holland
7,018,216 B1 3/2006 Clark et al.
7,018,235 B1 3/2006 Burris et al.
7,029,326 B2 4/2006 Montena
D521,454 S 5/2006 Murphy et al.
7,063,565 B2 6/2006 Ward
7,070,447 B1 7/2006 Montena
7,077,697 B2 7/2006 Kooiman
7,077,699 B2 7/2006 Islam et al.
7,086,897 B2 8/2006 Montena
7,090,525 B1 8/2006 Morana
7,094,114 B2 8/2006 Kurimoto
7,097,499 B1 8/2006 Purdy
7,102,868 B2 9/2006 Montena
7,108,547 B2 9/2006 Kisling et al.
7,108,548 B2 9/2006 Burris et al.
7,112,078 B2 9/2006 Czikora
7,112,093 B1 9/2006 Holland
7,114,990 B2 10/2006 Bence et al.
7,118,285 B2 10/2006 Fenwick et al.
7,118,382 B2 10/2006 Kerekes et al.
7,118,416 B2 10/2006 Montena et al.
7,125,283 B1 10/2006 Lin
7,128,603 B2 10/2006 Burris et al.
7,128,604 B2 10/2006 Hall
7,131,867 B1 11/2006 Foster et al.
7,131,868 B2 11/2006 Montena
7,140,645 B2 11/2006 Cronley
7,144,271 B1 12/2006 Burris et al.
7,144,272 B1 12/2006 Burris et al.
7,147,509 B1 12/2006 Burris et al.
7,153,159 B2 12/2006 Burris et al.
7,156,696 B1 1/2007 Montena
7,161,785 B2 1/2007 Chawgo
7,165,974 B2 1/2007 Kooiman
7,173,121 B2 2/2007 Fang
7,179,121 B1 2/2007 Burris et al.
7,179,122 B2 2/2007 Holliday
7,182,639 B2 2/2007 Burris
7,183,639 B2 2/2007 Mihara et al.
7,189,097 B2 3/2007 Benham
7,189,114 B1 3/2007 Burris et al.
7,192,308 B2 3/2007 Rodrigues et al.
7,229,303 B2 6/2007 Vermoesen et al.
7,238,047 B2 7/2007 Saetele et al.
7,252,536 B2 8/2007 Lazaro, Jr. et al.
7,252,546 B1 8/2007 Holland
7,255,598 B2 8/2007 Montena et al.
7,261,594 B2 8/2007 Kodama et al.
7,264,502 B2 9/2007 Holland
7,278,882 B1 10/2007 Li
7,288,002 B2 10/2007 Rodrigues et al.
7,291,033 B2 11/2007 Hu
7,297,023 B2 11/2007 Chawgo
7,299,550 B2 11/2007 Montena
7,303,435 B2 12/2007 Burris et al.
7,311,555 B1 12/2007 Burris et al.
7,318,609 B2 1/2008 Naito et al.
7,322,846 B2 1/2008 Camelio
7,322,851 B2 1/2008 Brookmire
7,329,139 B2 2/2008 Benham
7,331,820 B2 2/2008 Burris et al.
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,371,113 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall

(56) References Cited

U.S. PATENT DOCUMENTS

| | | | |
|---|---|---|---|
| 7,479,033 | B1 | 1/2009 | Sykes et al. |
| 7,479,035 | B2 | 1/2009 | Bence et al. |
| 7,484,988 | B2 | 2/2009 | Ma et al. |
| 7,484,997 | B2 | 2/2009 | Hofling |
| 7,488,210 | B1 | 2/2009 | Burris et al. |
| 7,494,355 | B2 | 2/2009 | Hughes et al. |
| 7,497,729 | B1 | 3/2009 | Wei |
| 7,500,868 | B2 | 3/2009 | Holland et al. |
| 7,500,873 | B1 | 3/2009 | Hart |
| 7,507,116 | B2 | 3/2009 | Laerke et al. |
| 7,507,117 | B2 | 3/2009 | Amidon |
| 7,513,788 | B2 | 4/2009 | Camelio |
| 7,537,482 | B2 | 5/2009 | Burris et al. |
| 7,540,759 | B2 | 6/2009 | Liu et al. |
| 7,544,094 | B1 | 6/2009 | Paglia et al. |
| 7,563,133 | B2 | 7/2009 | Stein |
| 7,566,236 | B2 | 7/2009 | Malloy et al. |
| 7,568,945 | B2 | 8/2009 | Chee et al. |
| 7,578,693 | B2 | 8/2009 | Yoshida et al. |
| 7,588,454 | B2 | 9/2009 | Nakata et al. |
| 7,607,942 | B1 | 10/2009 | Van Swearingen |
| 7,625,227 | B1 | 12/2009 | Henderson et al. |
| 7,632,143 | B1 | 12/2009 | Islam |
| 7,635,283 | B1 | 12/2009 | Islam |
| 7,648,393 | B2 | 1/2010 | Burris et al. |
| 7,651,376 | B2 | 1/2010 | Schreier |
| 7,674,132 | B1 | 3/2010 | Chen |
| 7,682,177 | B2 | 3/2010 | Berthet |
| 7,694,420 | B2 | 4/2010 | Ehret et al. |
| 7,714,229 | B2 | 5/2010 | Burris et al. |
| 7,726,996 | B2 | 6/2010 | Burris et al. |
| 7,727,011 | B2 | 6/2010 | Montena et al. |
| 7,749,021 | B2 | 7/2010 | Brodeur |
| 7,753,705 | B2 | 7/2010 | Montena |
| 7,753,710 | B2 | 7/2010 | George |
| 7,753,727 | B1 | 7/2010 | Islam et al. |
| 7,758,356 | B2 | 7/2010 | Burris et al. |
| 7,758,370 | B1 | 7/2010 | Flaherty |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,814,654 | B2 | 10/2010 | Pichler |
| D626,920 | S | 11/2010 | Purdy et al. |
| 7,824,216 | B2 | 11/2010 | Purdy |
| 7,828,594 | B2 | 11/2010 | Burris et al. |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,845,980 | B1 | 12/2010 | Amidon |
| 7,850,472 | B2 | 12/2010 | Friedrich et al. |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,914,326 | B2 | 3/2011 | Sutter |
| 7,918,687 | B2 | 4/2011 | Paynter et al. |
| 7,927,135 | B1 | 4/2011 | Wlos |
| 7,934,954 | B1 | 5/2011 | Chawgo et al. |
| 7,934,955 | B1 | 5/2011 | Hsia |
| 7,938,662 | B2 | 5/2011 | Burris et al. |
| 7,942,695 | B1 | 5/2011 | Lu |
| 7,950,958 | B2 | 5/2011 | Mathews |
| 7,950,961 | B2 | 5/2011 | Chabalowski et al. |
| 7,955,126 | B2 | 6/2011 | Bence et al. |
| 7,972,158 | B2 | 7/2011 | Wild et al. |
| 7,972,176 | B2 | 7/2011 | Burris et al. |
| 7,982,005 | B2 | 7/2011 | Ames et al. |
| 8,011,955 | B1 | 9/2011 | Lu |
| 8,025,518 | B2 | 9/2011 | Burris et al. |
| 8,029,315 | B2 | 10/2011 | Purdy et al. |
| 8,029,316 | B2 | 10/2011 | Snyder et al. |
| 8,037,599 | B2 | 10/2011 | Pichler |
| 8,047,872 | B2 | 11/2011 | Burris et al. |
| 8,062,044 | B2 | 11/2011 | Montena et al. |
| 8,062,063 | B2 | 11/2011 | Malloy et al. |
| 8,070,504 | B2 | 12/2011 | Amidon et al. |
| 8,075,337 | B2 | 12/2011 | Malloy et al. |
| 8,075,338 | B1 | 12/2011 | Montena |
| 8,079,860 | B1 | 12/2011 | Zraik |
| 8,087,954 | B2 | 1/2012 | Fuchs |
| 8,113,875 | B2 | 2/2012 | Malloy et al. |
| 8,113,879 | B1 | 2/2012 | Zraik |
| 8,157,587 | B2 | 4/2012 | Paynter et al. |
| 8,157,588 | B1 | 4/2012 | Rodrigues et al. |
| 8,167,635 | B1 | 5/2012 | Mathews |
| 8,167,636 | B1 | 5/2012 | Montena |
| 8,172,612 | B2 | 5/2012 | Bence et al. |
| 8,177,572 | B2 | 5/2012 | Feye-Hohmann |
| 8,192,237 | B2 | 6/2012 | Purdy et al. |
| 8,206,172 | B2 | 6/2012 | Katagiri et al. |
| D662,893 | S | 7/2012 | Haberek et al. |
| 8,231,412 | B2 | 7/2012 | Paglia et al. |
| 8,262,408 | B1 | 9/2012 | Kelly |
| 8,272,893 | B2 | 9/2012 | Burris et al. |
| 8,287,310 | B2 | 10/2012 | Burris et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,317,539 | B2 | 11/2012 | Stein |
| 8,319,136 | B2 | 11/2012 | Byron et al. |
| 8,323,053 | B2 | 12/2012 | Montena |
| 8,323,058 | B2 | 12/2012 | Flaherty et al. |
| 8,323,060 | B2 | 12/2012 | Purdy et al. |
| 8,337,229 | B2 | 12/2012 | Montena |
| 8,366,481 | B2 | 2/2013 | Ehret et al. |
| 8,366,482 | B2 | 2/2013 | Burris et al. |
| 8,376,769 | B2 | 2/2013 | Holland et al. |
| D678,844 | S | 3/2013 | Haberek |
| 8,398,421 | B2 | 3/2013 | Haberek et al. |
| 8,430,688 | B2 | 4/2013 | Montena et al. |
| 8,449,326 | B2 | 5/2013 | Holland et al. |
| 8,465,322 | B2 | 6/2013 | Purdy |
| 8,469,739 | B2 | 6/2013 | Rodrigues et al. |
| 8,469,740 | B2 | 6/2013 | Ehret et al. |
| D686,164 | S | 7/2013 | Haberek et al. |
| D686,576 | S | 7/2013 | Haberek et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,506,325 | B2 | 8/2013 | Malloy et al. |
| 8,517,763 | B2 | 8/2013 | Burris et al. |
| 8,517,764 | B2 | 8/2013 | Wei et al. |
| 8,529,279 | B2 | 9/2013 | Montena |
| 8,550,835 | B2 | 10/2013 | Montena |
| 8,568,163 | B2 | 10/2013 | Burris et al. |
| 8,568,165 | B2 | 10/2013 | Wei et al. |
| 8,591,244 | B2 | 11/2013 | Thomas et al. |
| 8,597,050 | B2 | 12/2013 | Flaherty et al. |
| 8,622,776 | B2 | 1/2014 | Morikawa |
| 8,636,529 | B2 | 1/2014 | Stein |
| 8,636,541 | B2 | 1/2014 | Chastain et al. |
| 8,647,136 | B2 | 2/2014 | Purdy et al. |
| 8,690,603 | B2 | 4/2014 | Bence et al. |
| 8,721,365 | B2 | 5/2014 | Holland |
| 8,727,800 | B2 | 5/2014 | Holland et al. |
| 8,758,050 | B2 | 6/2014 | Montena |
| 8,777,658 | B2 | 7/2014 | Holland et al. |
| 8,777,661 | B2 | 7/2014 | Holland et al. |
| 8,858,251 | B2 | 10/2014 | Montena |
| 8,888,526 | B2 | 11/2014 | Burris |
| 8,920,192 | B2 | 12/2014 | Montena |
| 9,017,101 | B2 | 4/2015 | Ehret et al. |
| 9,048,599 | B2 | 6/2015 | Burris |
| 9,153,911 | B2 | 10/2015 | Burris et al. |
| 9,166,348 | B2 | 10/2015 | Burris et al. |
| 9,172,154 | B2 | 10/2015 | Burris |
| 9,172,157 | B2 | 10/2015 | Burris |

(56) References Cited

U.S. PATENT DOCUMENTS

2001/0034143 A1 10/2001 Annequin
2001/0046802 A1 11/2001 Perry et al.
2001/0051448 A1 12/2001 Gonzales
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0113107 A1 6/2006 Williams
2006/0154519 A1 7/2006 Montena
2006/0166552 A1 7/2006 Bence et al.
2006/0178046 A1 8/2006 Tusini
2006/0194465 A1 8/2006 Czikora
2006/1078034 8/2006 Shimirak
2006/0199040 A1 9/2006 Yamada
2006/0211304 A1* 9/2006 Holland ..... H01R 9/0518 439/585
2006/0223355 A1 10/2006 Hirschmann
2006/0246774 A1 11/2006 Buck
2006/0258181 A1* 11/2006 Holland ..... H01R 9/0518 439/63
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0155233 A1* 7/2007 Laerke ..... H01R 9/0521 439/578
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0274644 A1 11/2008 Rodrigues
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255721 A1 10/2010 Purdy et al.
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0143567 A1 6/2011 Purdy et al.
2011/0151714 A1 6/2011 Flaherty et al.
2011/0230089 A1 9/2011 Amidon et al.
2011/0230091 A1 9/2011 Krenceski et al.
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik
2012/0040537 A1 2/2012 Burris
2012/0045933 A1 2/2012 Youtsey
2012/0064768 A1 3/2012 Islam et al.
2012/0094530 A1 4/2012 Montena
2012/0100751 A1 4/2012 Montena
2012/0108098 A1* 5/2012 Burris ..... H01R 13/639 439/345
2012/0122329 A1 5/2012 Montena
2012/0129387 A1 5/2012 Holland et al.
2012/0171894 A1 7/2012 Malloy et al.
2012/0178289 A1 7/2012 Holliday
2012/0202378 A1 8/2012 Krenceski et al.
2012/0222302 A1 9/2012 Purdy et al.
2012/0225581 A1 9/2012 Amidon et al.
2012/0315788 A1 12/2012 Montena
2013/0065433 A1 3/2013 Burris
2013/0072057 A1 3/2013 Burris
2013/0178096 A1 7/2013 Matzen
2013/0273761 A1 10/2013 Ehret et al.
2014/0106612 A1 4/2014 Burris
2014/0106613 A1 4/2014 Burris
2014/0120766 A1 5/2014 Meister et al.
2014/0137393 A1 5/2014 Chastain et al.
2014/0148044 A1 5/2014 Balcer et al.
2014/0148051 A1 5/2014 Bence et al.
2014/0154907 A1 6/2014 Ehret et al.
2014/0298650 A1 10/2014 Chastain et al.
2014/0322968 A1 10/2014 Burris
2014/0342605 A1 11/2014 Burris et al.

(56) References Cited

U.S. PATENT DOCUMENTS

| | | | |
|---|---|---|---|
| 2015/0118901 | A1 | 4/2015 | Burris |
| 2015/0295331 | A1 | 10/2015 | Burris |

FOREIGN PATENT DOCUMENTS

| | | |
|---|---|---|
| CN | 201149936 | 11/2008 |
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3117320 | 4/1982 |
| DE | 3211008 | 10/1983 |
| DE | 9001608.4 | 4/1990 |
| DE | 4439852 | 5/1996 |
| DE | 19749130 | 8/1999 |
| DE | 19957518 | 9/2001 |
| DE | 10346914 | 5/2004 |
| DE | 102004031271 | 1/2006 |
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4129978 | 8/2008 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| TW | 200843262 | 11/2008 |
| WO | 8700351 | 1/1987 |
| WO | 00/05785 | 2/2000 |
| WO | 0186756 | 11/2001 |
| WO | 02069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Digicon AVL Connector. ARRIS Group Inc. [online] 3 pages. Retrieved from the Internet: <URL: http://www.arrisi.com/special/digiconAVL.asp.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE 01 2006; "Specification for"F Port, Female, Outdoor. Published Jan. 2006. 9 pages.

The American Society of Mechanical Engineers; "Lock Washers (Inch Series), An American National Standard"; ASME 818.21.1-1999 (Revision of ASME 618.21.1-1994); Reaffirmed 2005. Published Feb. 11, 2000. 28 pages.

U.S. Reexamination Control No. 90/012,300 filed Jun. 29, 2012, regarding U.S. Pat. No. 8,172,612 filed May 27, 2011 (Bence et al.).

U.S. Reexamination Control No. 90/012,749 filed Dec. 21, 2012, regarding U.S. Pat. No. 7,114,990, filed Jan. 25, 2005 (Bence et al.).

U.S. Reexamination Control No. 90/012,835 filed Apr. 11, 2013, regarding U.S. Pat. No. 8,172,612 filed May 27, 2011 (Bence et al.).

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.

PPC, "Next Generation Compression Connectors," pp. 1-6, Retrieved from http://www.tessco.com/yts/partnermanufacturer list/vendors/ppc/pdf/ppc digitalspread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.

Slade, Paul G,. Electrical Contacts: Principles and Applications, 1999, Retrieved from http://books.google.com/books (table of contents only).

U.S. Reexamination Control No. 95/002,400 filed Sep. 15, 2012, regarding U.S. Pat. No. 8,192,237 filed Feb. 23, 2011 (Purdy et al.).

U.S. Reexamination Control No. 90/013,068 filed Nov. 27, 2013, regarding U.S. Pat. No. 6,558,194 filed Jul. 21, 2000 (Montena).

U.S. Reexamination Control No. 90/013,069 filed Nov. 27, 2013, regarding U.S. Pat. No. 6,848,940 filed Jan. 21, 2003 (Montena).

U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).

U.S. Inter Partes Review Case No. 2013-00343 filed Jun. 10, 2013, regarding U.S. Pat. No. 8,313,353 filed Apr. 30, 2012, claims 1-6 (Purdy et al.).

U.S. Inter Partes Review Case No. 2013-00340 filed Jun. 10, 2013, regarding U.S. Pat. No. 8,323,060 filed Jun. 14, claims 1-9 (Purdy et al.).

U.S. Inter Partes Review Case No. 2013-00347 filed Jun. 10, 2013, regarding U.S. Pat. No. 8,287,320 filed Dec. 8, 2009, claims 9, 17, 32 (Purdy et al.).

(56) References Cited

OTHER PUBLICATIONS

U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Office Action dated Jun. 24, 2015 pertaining to U.S. Appl. No. 13/652,969.
Patent Cooperation Treaty, International Preliminary Report on Patentability for PCT/US2013/064512, mail date Apr. 30, 2015, 9 pages.
Patent Cooperation Treaty, International Preliminary Report on Patentability for PCT/US2013/064515, mail date Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. Nos. 8,313,353; 8,313,345; 8,323,060—Eastern District of Arkansas.
Report on the Filing or Determination of an Action Regarding a Patent or Trademark regarding U.S. Pat. Nos. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.
Office Action dated Mar. 10, 2016 pertaining to U.S. Appl. No. 14/166,653.
CN2013800048358 Search Report Dated Jan. 19, 2016.
EP13733586.5 Search Report Dated Aug. 4, 2015.
International Search Report and Written Opinion of the International Searching Authority; PCT/US13/20001; Mailed Mar. 19, 2013.
Taiwan Search Report for application No. 102100147, dated Mar. 28, 2016, 1 page.

* cited by examiner

QUICK MOUNT CONNECTOR FOR A COAXIAL CABLE

RELATED APPLICATIONS

This application is a continuation of currently pending U.S. patent application Ser. No. 13/732,679 filed Jan. 2, 2013 which claims the benefit of priority under 35 U.S.C. §119 of U.S. Provisional Application Ser. No. 61/583,385 filed on Jan. 5, 2012 the content of which is relied upon and incorporated herein by reference in its entirety.

BACKGROUND

1. Field

The present invention relates generally to coaxial cable connectors, and particularly to quick mount Type F connectors for use with minimally prepared coaxial cables.

2. Technical Background

Coaxial cable connectors such as F-connectors are used to attach coaxial cables to another object such as an appliance or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is typically secured over the prepared end of the jacketed coaxial cable, allowing the end of the coaxial cable to be connected with a terminal block, such as by a threaded connection with a threaded terminal of a terminal block.

Crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable.

Still another form of F-connector is known wherein an annular compression sleeve is used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for following such compression sleeve to be passed over the end of the coaxial cable prior to installation of the F-connector. The end of the coaxial cable must be prepared by removing a portion of the outer braid and/or folding the outer braid back over the cable jacket. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen; such patent discloses a compression sleeve type F-connector known in the industry as "Snap-n-Seal." A number of commercial tool manufacturers provide compression tools for axially compressing the compression sleeve into such connectors.

It is known in the coaxial cable field generally that collars or sleeves within a coaxial cable connector can be compressed inwardly against the outer surface of a coaxial cable to secure a coaxial cable connector thereto. For example, in U.S. Pat. No. 4,575,274 to Hayward, a connector assembly for a signal transmission system is disclosed wherein a body portion threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, the connector shown in the Hayward '274 patent can not be installed quickly, as by a simple crimp or compression tool; rather, the mating threads of such connector must be tightened, as by using a pair of wrenches. Additionally, the end of the coaxial cable must be prepared by stripping back the outer jacket and the conductive grounding sheath, all of which takes time, tools, and patience.

SUMMARY

In one aspect, a post-less coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor is disclosed, the post-less coaxial cable connector including a body having an internal surface extending between front and rear ends of the body, the internal surface defining a longitudinal opening, and a collapsible groove disposed between the front and rear ends, a shell having an outer surface and an internal surface, the internal surface defining an opening through the shell, the internal surface slidingly engaging at least a portion of the rear end of the body, and a compression ring disposed within the shell and engaging the rear end of the body, the compression ring having an internal surface and at least a portion of the internal surface having projections disposed around at least a portion thereof, wherein upon compression of the post-less coaxial cable connector the projections of the compression ring engage the jacket of the coaxial cable to prevent rotation of the coaxial cable relative to the post-less coaxial cable connector and a portion of the body comprising a portion of the collapsible groove is compressed radially inwardly to engage the outer conductor of the coaxial cable.

In some embodiments, upon compression of the post-less coaxial cable connector, the shell pushes the compression ring against the rear end of the body, causing the collapsible groove to be compressed axially and a portion thereof to engage the outer conductor before the compression ring is compressed radially inwardly to engage the outer jacket of the coaxial cable In other embodiments, the post-less coaxial cable connector includes a coupling portion rotatably engaging the front end of the body.

In yet other embodiments, the compression ring and shell seal the rear end of the post-less coaxial cable connector.

In yet another aspect, a combination of a coaxial cable and a post-less coaxial cable connector for terminating an end of the coaxial cable is provided, the coaxial cable comprising an inner conductor, a dielectric surrounding the inner conductor, an outer conductor surrounding the dielectric, and a jacket surrounding the outer conductor, the post-less coaxial cable connector includes a body having an internal surface extending between front and rear ends of the body, the internal surface defining an longitudinal opening, and a collapsible groove disposed between the front and rear ends, a shell having an outer surface and an internal surface, the internal surface defining an opening therein, the internal surface slidingly engaging the rear end of the body, a compression ring disposed within the shell and engaging the rear end of the body, the compression ring having an internal surface and at least a portion of the internal surface having projections disposed around at least a portion thereof, wherein the coaxial cable extends through the shell, the compression ring, and the body, wherein the dielectric and the outer conductor terminate at the front end of the body, the inner conductor extends beyond the coupling portion and the jacket terminates about the rear end of the body.

In still yet another aspect, a method is provided for connecting a coaxial cable to a post-less coaxial cable connector, the method includes providing a post-less coaxial cable connector comprising a body having an internal surface extending between front and rear ends of the body, the internal surface defining an longitudinal opening, and a collapsible groove disposed between the front and rear ends, a shell having an outer surface and an internal surface, the internal surface defining an opening therein, the internal surface slidingly engaging the rear end of the body, and a compression ring disposed within the shell and engaging the rear end of the body, the compression having an internal surface and at least a portion of the internal surface having projections disposed around at least a portion thereof, providing a coaxial cable comprising an inner conductor, a dielectric surrounding the inner conductor, an outer conductor surrounding the dielectric, and a jacket surrounding the outer conductor, preparing the coaxial cable by exposing a predetermined length of the center conductor and a predetermined length of the outer conductor, the outer conductor covering the underlying dielectric, inserting the prepared coaxial cable into the shell, the compression ring, and the body, wherein the dielectric and the outer conductor terminate at the front end of the body, the inner conductor extends beyond the coupling portion and the jacket terminates about the rear end of the body, axially compressing the post-less coaxial cable connector thereby causing the shell to push the compression ring against the rear end of the body, causing the collapsible groove to be compressed axially and a portion thereof to engage the outer conductor before the compression ring is compressed radially inwardly by the shell to engage the outer jacket of the coaxial cable.

Additional features and advantages of the invention will be set forth in the detailed description which follows, and in part will be readily apparent to those skilled in the art from that description or recognized by practicing the invention as described herein, including the detailed description, which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention.

DETAILED DESCRIPTION

Figure 1:
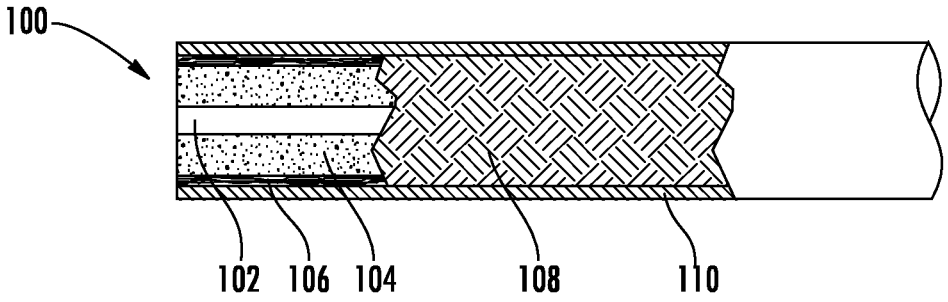
FIG. 1 is a partial cross section of a coaxial cable useful for description of the various cable constituents.

Reference will now be made in detail to the present preferred embodiment(s) of the invention, examples of which are illustrated in the accompanying drawings. Whenever possible, the same reference numerals will be used throughout the drawings to refer to the same or like parts.

Figure 1A:
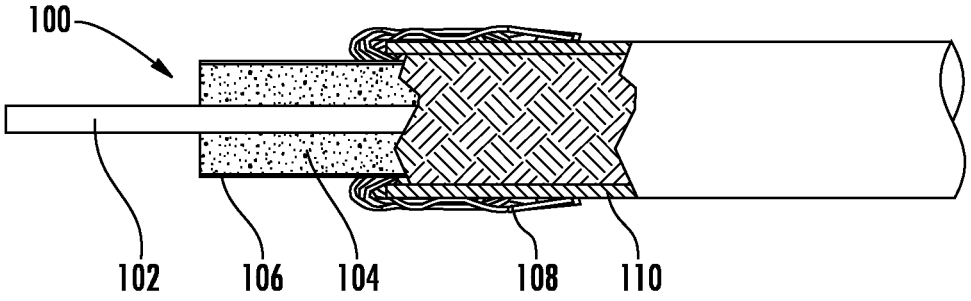
FIG. 1A PRIOR ART
FIG. 1A is a partial cross section of a prepared coaxial cable using prior art preparation methods.
Figure 1B:
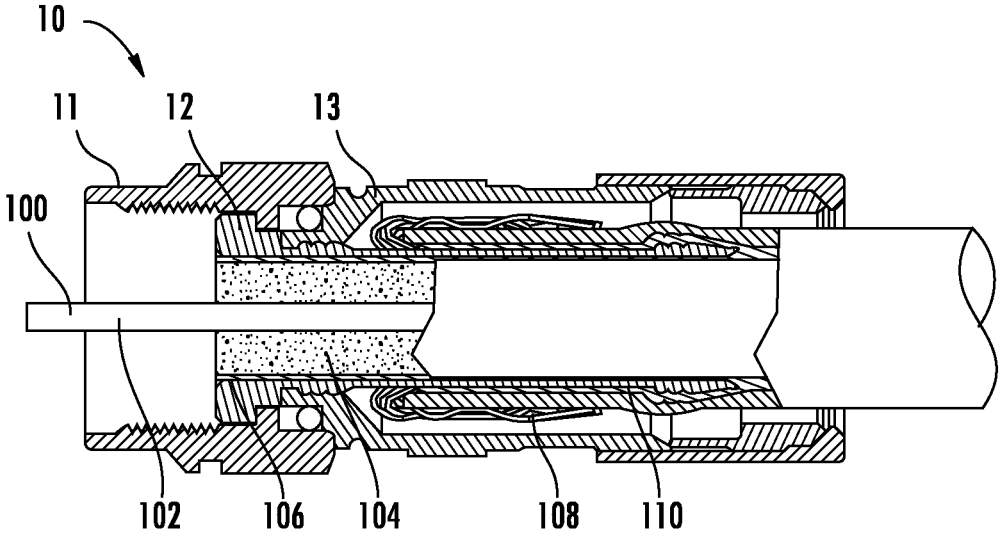
FIG. 1B PRIOR ART
FIG. 1B is a partial cross section of a prior art coaxial connector utilizing a post with a coaxial cable installed.

Referring to FIGS. 1, 1A, and 1B, a prior art coaxial cable 100 is illustrated and the method in which the end of the coaxial cable 100 is prepared. Referring to FIG. 1, the coaxial cable 100 has a center conductor 102 that is surrounded by a dielectric layer 104. The dielectric layer (or dielectric) 104 may also have a foil or other metallic covering 106. Coaxial cable 100 then has a braided outer conductor 108 which is covered and protected by a jacket 110. Typically, to prepare the coaxial cable 100 for attachment to a coaxial cable connector, a portion of the center conductor 102 is exposed as illustrated in FIG. 1A. The jacket 110 is trimmed back so that a portion of the dielectric 104 (and metallic covering 106) and braided outer conductor 108 are exposed. The braided outer conductor 108 is then folded back over the jacket 110, to expose the dielectric (and the metallic covering 106 if present).

FIG. 1B illustrates the prepared coaxial cable of FIG. 1A inserted into a prior art coaxial connector 10. The connector 10 has a coupling 11 beyond which the center conductor 102 extends and is attached to a body portion 13. Inside the body portion 13 is a post 12, the post 12 is used to secure the coaxial cable 100 relative to the coaxial connector 10. As can be seen in FIG. 1B, the post 12 is inserted into the cable 100 between the braided outer conductor 108 and the dielectric 104. The post 12 can cause problems for the coaxial connector 10 as well as the installer. First, the coaxial cable 100 must be prepared and then the post 12 must be inserted into the coaxial cable 100. Second, the post 12 can skive the coaxial cable 100, tear the braided outer conductor 108 or the jacket 110. Additionally, it can be difficult to insert the post 12 into the coaxial cable 100.

Figure 2:
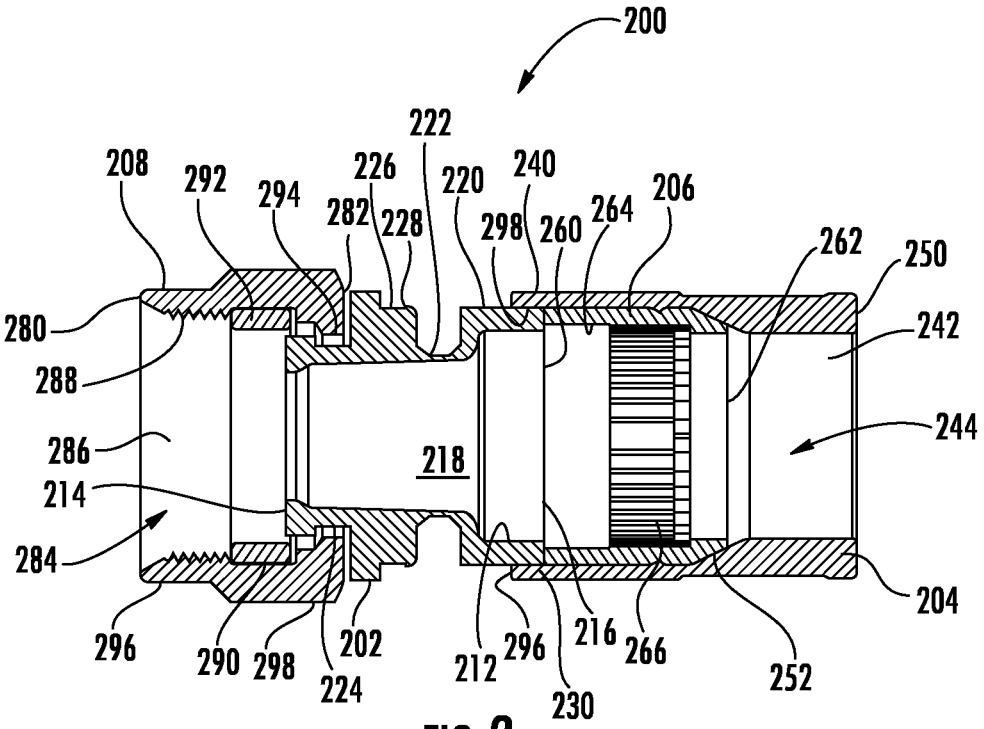
FIG. 2 is a cross sectional view of one embodiment of a post-less coaxial cable connector according to the present invention.

One embodiment of a post-less coaxial cable connector 200 according to the present invention is illustrated in FIG. 2. The post-less coaxial cable connector 200 has a body 202, a shell 204, a compression ring 206, and a coupling portion 208. It should be noted that the post-less coaxial cable connector 200 does not have a post that engages the coaxial cable between the dielectric and the outer conductor as illustrated above. The body 202 has an internal surface 212 that extends between the front end 214 and the rear end 216 that defines a longitudinal opening 218. The body 202 also has an outer surface 220 that has a collapsible groove 222 positioned between the front end 214 and the rear end 216. The body 202 also has an annular groove 224 disposed adjacent the front end 214 to engage and retain the coupling portion 208, described in more detail below. Disposed between the annular groove 224 and the collapsible groove 222 is retaining groove 226 with a forward facing surface 228 that engages and retains the shell 204 in a compressed state as described below. The outer surface 220 also has an annular projection 230 adjacent the rear end 216 of body 202 to prevent the shell 204 from falling off the rear end 216. The body 202 is preferably made from brass, but may be made from any appropriate material.

The shell 204 has an outer surface 240 and an internal surface 242, the internal surface 242 defining an opening 244 therethrough. The shell 204 has at front end 246 an annular ring 248 to engage and be retained on the body 202 by the annular projection 230. As can be seen in FIG. 2, the opening 244 is wider at the front end 246 than at the back end 250 due to the forward and inward facing surface 252. The shell 204 is preferably also made from brass, but may be made from any appropriate material.

The compression ring 206 is disposed within the opening 244 of the shell 204. The compression ring 206 has a front end 260 and a rear end 262. The front end 260 is preferably disposed against the rear end 216 of the body 202 and the rear end 262 is disposed against the surface 252 of the shell 204. The compression ring 206 has an internal surface 264 that also includes a ring of projections 266. The projections 266 are preferably disposed completely around the circumference of the internal surface 264 as illustrated in FIG. 2. However, they may go only partially around the internal surface 264 or be intermittently disposed around the internal surface 264. Additionally, the projections 266 need only extend along a portion of the length of the compression ring 206, but may extend along the entirety thereof or be present in several places. The projections 266 serve to engage the outer jacket of the coaxial cable to prevent rotation of the coaxial cable relative to the post-less coaxial cable connector 200. The compression ring 206 is preferably made from a plastic material (a polymer), but may be made of any appropriate material.

The coupling portion 208 has a front end 280, a back end 282, and an opening 284 extending there between. The opening 284 of the coupling portion 208 has an internal surface 286. The internal surface 286 includes a threaded portion 288 and a channel 290. The channel 290 is configured to receive an elastic ring 292 to seal the post-less coaxial cable connector 200. The coupling portion 208 also an inwardly projecting ring 294 to engage the annular groove 224 disposed adjacent the front end 214 of body 202. The coupling portion 208 also has a smooth outer surface 296 adjacent the front end 280 and a hexagonal configuration 298 adjacent the back end 282. The coupling portion 208 is preferably made from a metallic material, such as brass, and it is plated with a conductive, corrosion-resistant material, such as nickel, but it may be made from any appropriate material.

Figure 3:
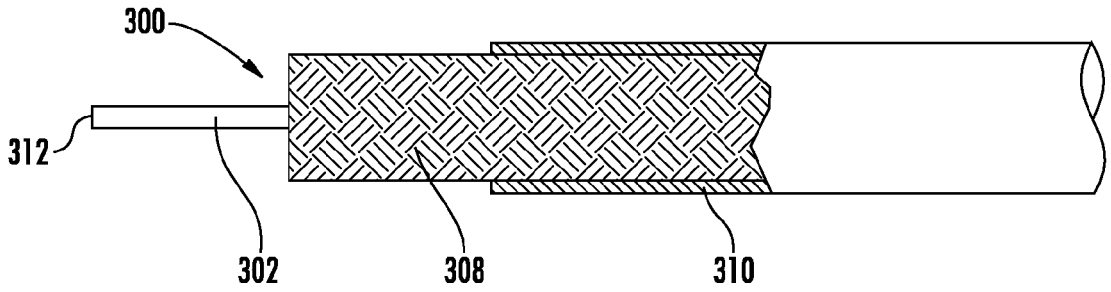
FIG. 3 is a partial cross section of a prepared coaxial cable using one method of preparation according to the present invention.

FIG. 3 illustrates a coaxial cable 300 in a prepared state for use with the the post-less coaxial cable connector 200. The coaxial cable 300 is substantially like the coaxial cable 100 noted above, it is just different in how the cable end is prepared for use. As illustrated in FIG. 3, the coaxial cable has a center conductor 302 that is surrounded by a dielectric layer 304. Coaxial cable 300 then has a braided outer conductor 308 which is covered and protected by a jacket 310. In FIG. 3, the dielectric layer 304 is not visible as it may be cut flush with, and, thereby, covered by, the braided outer conductor 308. The dielectric layer (or dielectric) 304 may also have a foil or other metallic covering (also covered by braided outer conductor 308). The braided outer conductor 308 is illustrated as having a parquet-floor-like pattern, but it may be any outer conductor. From the end 312 of the coaxial cable 300, the center conductor 302 is exposed by removing the dielectric layer 304, the foil or other metallic covering, the braided outer conductor 308 and the jacket 310. A second portion of the coaxial cable 300 then has only the jacket 310 removed, leaving the dielectric layer 304, the foil or other metallic covering and the braided outer conductor 308 intact. As noted above, the prior art required that the braided outer conductor 308 be folded back over the jacket 310. This preparation requires less time than the other method of preparation.

Figure 4:
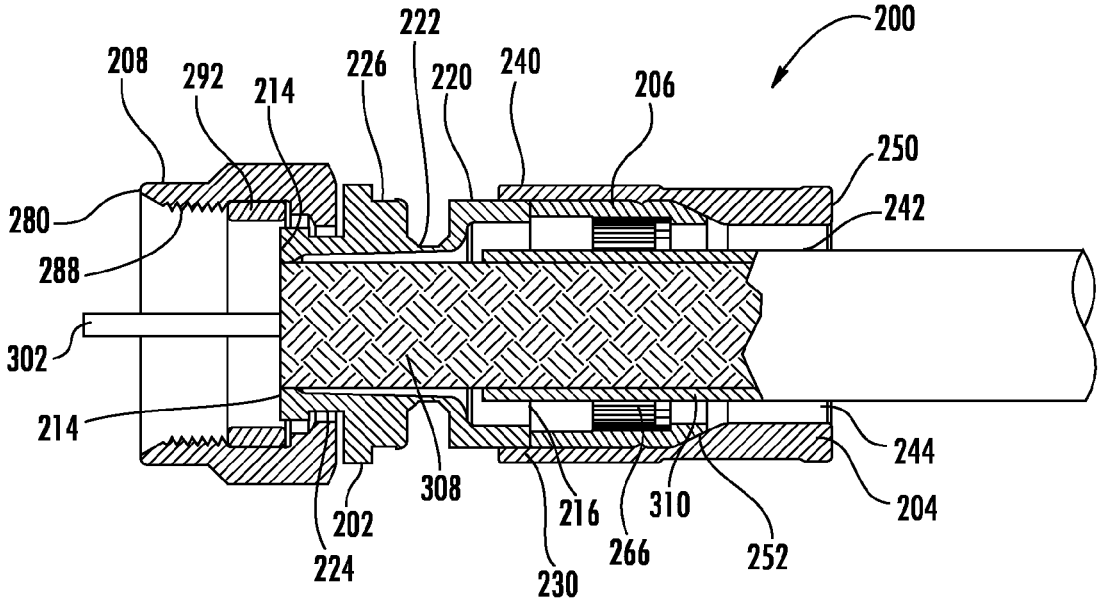
FIG. 4 is a cross section of the post-less coaxial cable connector of FIG. 2 in an un-compressed or open condition with the prepared coaxial cable of FIG. 3 inserted therein.

The assembly of the post-less coaxial cable connector 200 will now be discussed with reference to FIGS. 4-6. As can be seen in FIG. 4, the prepared coaxial cable 300 is inserted through the opening 244 of the shell 204, through the compression ring 206, and into the body 202, wherein the dielectric 304 and the outer conductor 308 terminate at the front end 214 of the body 202. The inner conductor 302 extends through and beyond the coupling portion 208, while the jacket 310 terminates about the rear end 216 of the body 202.

Figure 5:
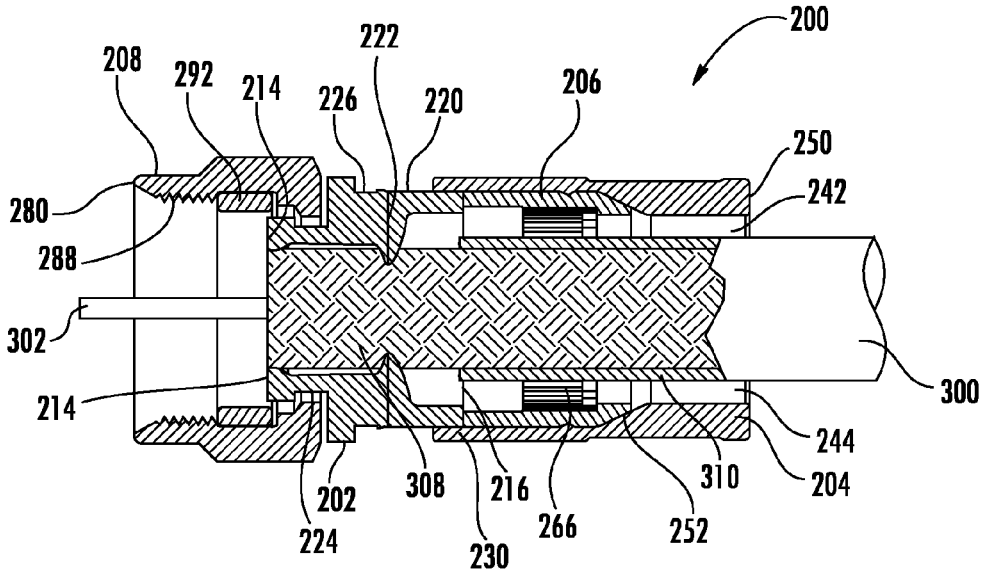
FIG. 5 is a cross section of the post-less coaxial cable connector and prepared coaxial cable of FIG. 4 in a first stage of compression.

FIG. 5 illustrates the post-less coaxial cable connector 200 as it is being partially axially compressed. The axial compression tool is not illustrated to allow for clarity of the figures. As the tool engages the rear end 250 of the shell 204 (and the front end 280 of the coupling portion 208), the shell 204 engages the compression ring 206 by way of the surface 252 and drives it forward. As the front end of the compression ring 206 is disposed against the rear end 216 of the body 202, it drives the rear end 216 of the body 202 towards the front of the body 202. This causes the collapsible groove 222 to collapse and drives a portion of the body 202 radially inward to engage the coaxial cable 300 and in particular the outer conductor 308 and the dielectric 304 underneath the outer conductor 308. This engagement of the body 202 with the coaxial cable 300 provides appropriate pull strength for the coaxial cable 300. The body 202 and the outer conductor 308 are also in electrical communication with one another as required.

Figure 6:
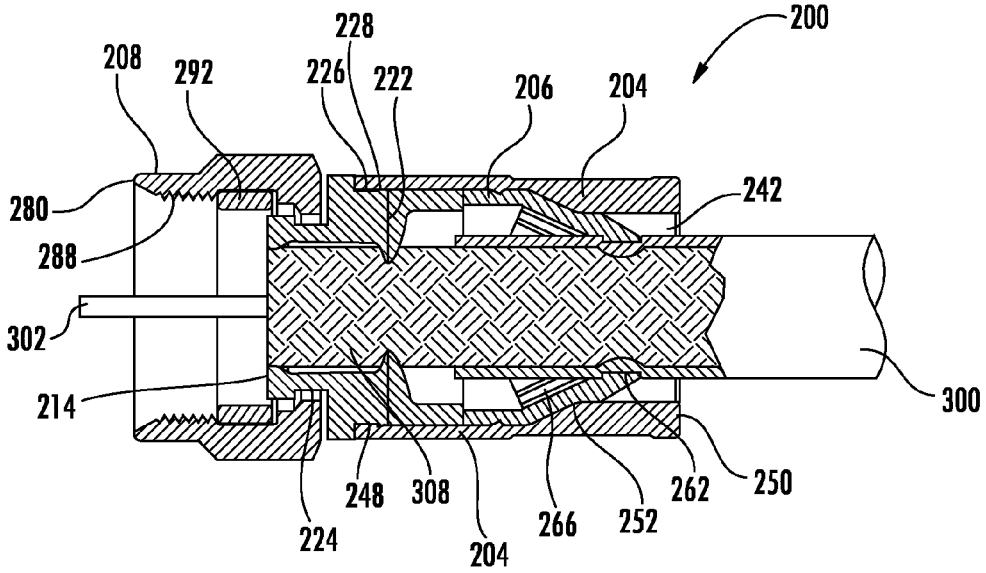
FIG. 6 is a partial cross section of the post-less coaxial cable connector and prepared coaxial cable of FIG. 4 in a second and final stage of compression.

In FIG. 6, the axial compression of the post-less coaxial cable connector 200 has been completed. As can be seen, the shell 204 has been moved axially forward even more than in FIG. 5, and the surface 252 has caused the compression ring 206 to be forced radially inward against the coaxial cable 300 and the jacket 310 in particular. Since the compression ring 206 was fully engaged with the body 202, when the collapsible groove was compressed and narrowed, the shell 204 had to move relative to the compression ring 206 and the surface 252 pushed the compression ring 206 and the projections 266 into the jacket 310. These projections 266 grab the jacket 310 and provide appropriate anti-rotation torque. Since the compression ring 206 is pushed radially inward into the jacket 310, it forms a seal at the rear end of the post-less coaxial cable connector 200.

The annular ring 248 of the shell 204 engages the retaining groove 226 of body 202 and the forward facing surface 228 of retaining groove 226 prevents the backward movement of the shell 204 relative to the body 202.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

I claim:

1. A post-less coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the post-less coaxial cable connector comprising:

a body having an internal surface extending between front and rear ends of the body, the internal surface defining a longitudinal opening, and a collapsible groove disposed between the front and rear ends;

a shell having an outer surface and an internal surface, the internal surface defining an opening through the shell, the internal surface slidingly engaging at least a portion of the rear end of the body; and a compression ring disposed within the shell and engaging the rear end of the body, the compression ring having an internal surface and at least a portion of the internal surface having projections disposed around at least a portion thereof.

2. The post-less coaxial cable connector according to claim 1, wherein upon compression of the post-less coaxial cable connector, the shell pushes the compression ring against the rear end of the body, causing the collapsible groove to be compressed axially and a portion thereof to engage the outer conductor before the compression ring is compressed radially inwardly to engage the outer jacket of the coaxial cable.

3. The post-less coaxial cable connector according to claim 1, further comprising a coupling portion rotatably engaging the front end of the body.

4. The post-less coaxial cable connector according to claim 3, further comprising an elastic ring disposed in an opening of the coupling portion to seal the front end of the post-less coaxial cable connector.

5. The post-less coaxial cable connector according to claim 1, wherein the internal surface of the compression ring has projections disposed around a circumference thereof.

6. The post-less coaxial cable connector according to claim 1, wherein the collapsible groove is disposed in an outer surface of the body.

7. The post-less coaxial cable connector according to claim 2, wherein the compression ring and shell seal the rear end of the post-less coaxial cable connector.

8. A combination of a coaxial cable and a post-less coaxial cable connector for terminating an end of the coaxial cable, the coaxial cable comprising an inner conductor, a dielectric surrounding the inner conductor, an outer conductor surrounding the dielectric, and a jacket surrounding the outer conductor, the post-less coaxial cable connector comprising:

a body having an internal surface extending between front and rear ends of the body, the internal surface defining an longitudinal opening, and a collapsible groove disposed between the front and rear ends;

a shell having an outer surface and an internal surface, the internal surface defining an opening therein, the internal surface slidingly engaging the rear end of the body; and a compression ring disposed within the shell and engaging the rear end of the body, the compression ring having an internal surface and at least a portion of the internal surface having projections disposed around at least a portion thereof.

9. The combination of a coaxial cable and a post-less coaxial cable connector according to claim 8, wherein upon compression of the post-less coaxial cable connector, the shell pushes the compression ring against the rear end of the body, causing the collapsible groove to be compressed axially and a portion thereof to engage the outer conductor before the compression ring is compressed radially inwardly to engage the outer jacket of the coaxial cable.

10. The combination of a coaxial cable and a post-less coaxial cable connector according to claim 8, further comprising a coupling portion rotatably engaging the front end of the body.

11. The combination of a coaxial cable and a post-less coaxial cable connector according to claim 8, further comprising an elastic ring disposed in an opening of the coupling portion to seal the front end of the post-less coaxial cable connector.

12. The combination of a coaxial cable and a post-less coaxial cable connector according to claim 8, wherein the internal surface of the compression ring has projections disposed around a circumference thereof.

13. The combination of a coaxial cable and a post-less coaxial cable connector according to claim 8, wherein the collapsible groove is disposed in an outer surface of the body.

14. The combination of a coaxial cable and a post-less coaxial cable connector according to claim 8, wherein the compression ring and shell seal the rear end of the post-less coaxial cable connector.

* * * * *